United States Patent [19]

Wax

[11] 4,206,381

[45] Jun. 3, 1980

[54] LEAN BURN SPARK PLUG

[76] Inventor: Bernard Wax, 28 Highland Ave., Succasunna, N.J. 07876

[21] Appl. No.: 22,322

[22] Filed: Mar. 20, 1979

Related U.S. Application Data

[63] Continuation-in-part of Ser. No. 828,661, Aug. 29, 1977, abandoned.

[51] Int. Cl.[2] ..... H01T 13/32

[52] U.S. Cl. ..... 313/139; 313/141

[58] Field of Search ..... 313/141, 139, 138, 142

[56] References Cited

U.S. PATENT DOCUMENTS

| | | | |
|---|---|---|---|
| 1,384,818 | 7/1921 | Bathurst | 313/141 |
| 1,495,499 | 5/1924 | Stanislawski | 313/139 X |
| 1,710,056 | 4/1929 | Griffin | 313/141 X |
| 2,207,175 | 7/1940 | Kral | 313/139 X |
| 2,208,059 | 7/1940 | Stahr | 313/136 X |
| 2,298,504 | 10/1942 | Ost | 313/139 X |
| 2,299,924 | 10/1942 | Ost | 313/139 X |
| 3,872,338 | 3/1975 | Wax | 313/141 X |
| 3,965,384 | 6/1976 | Yamazaki | 313/142 |
| 4,023,058 | 5/1977 | Lara et al. | 313/139 |

*Primary Examiner*—Palmer C. Demeo

*Attorney, Agent, or Firm*—Rudolph J. Jurick

[57] ABSTRACT

A spark plug having means for concentrating a portion of the fuel mixture in the spark gap during the compression cycle of an internal combustion engine and means for increasing the burn rate of the fuel mixture upon ignition, thereby providing positive ignition of a lean fuel mixture without decrease in the horsepower output of the engine, as otherwise would be the case.

5 Claims, 8 Drawing Figures

LEAN BURN SPARK PLUG

This application is a continuation-in-part application of Ser. No. 828,661, filed Aug. 29, 1977, and now abandoned.

BACKGROUND OF THE INVENTION

Spark plugs of various constructions have been provided for increasing the operating efficiency of an internal combustion engine. Certain prior spark plugs have electrode arrangements for producing a plurality of sparks during each firing cycle of the plug as, for example, the construction shown in J. A. Stahr U.S. Pat. No. 2,208,059, issued July 16, 1940. Other spark plugs have electrodes constructed and arranged to be self-cleaning, as shown in T. T. Bathurst U.S. Pat. No. 1,384,818, issued July 19, 1921. My U.S. Pat. No. 3,872,338, issued Mar. 18, 1975 discloses a spark plug in which the electrodes are encased in a non-conducting material to eliminate electric and chemical corrosion of the electrodes, thereby prolonging the operating life of the spark plug. Still other spark plugs are provided with auxiliary members for modifying the propagation of the combustion flame, as shown in K. Yamazaki U.S. Pat. No. 3,965,384, issued June 22, 1976. While the prior spark plugs provide varying degrees of improved operating results, they do not result in a significant increase in the horsepower output of an engine under given engine operating conditions, and, also, the prior spark plugs do not provide positive ignition of a lean fuel mixture. A spark plug made in accordance with this invention permits the use of a much leaner fuel mixture than is possible with prior spark plugs and without the normally expected decrease in engine horsepower output.

SUMMARY OF THE INVENTION

In accordance with one embodiment of this invention, a metal, ring member is secured to the shell of the spark plug, said member having a center bar which is spaced from an end of a main electrode to form the spark gap. In another embodiment, the spark gap if formed between the main electrode and the circular portion of the ring member. The ring member may have various overall configurations and cross-sectional shapes.

An object of this invention is the provision of a spark plug having electrodes arranged and constructed to provide positive ignition of a lean fuel mixture.

An object of this invention is the provision of a spark plug of improved construction which provides increased operating efficiency of an internal combustion engine resulting in a decrease in the amount of pollutants discharged into the atmosphere.

An object of this invention is the provision of a spark plug in which the ground electrode is arranged to momentarily increase the concentration of the fuel mixture in the spark gap during the compression stroke of an internal combustion engine.

An object of this invention is the provision of a spark plug in which the ground electrode is arranged to improve propagation of a combustion flame within the cylinder of an internal combustion engine.

The above stated and other objects and advantages of the invention will become apparent from the following description when taken with the accompanying drawings. It will be understood, however, that the drawings are for purposes of illustration and are not to be construed as defining the scope or spirit of the invention, reference being had for the latter purpose to the claims appended hereto.

BRIEF DESCRIPTION OF THE DRAWINGS

In the drawings wherein like reference characters denote like parts in the several views.

DESCRIPTION OF PREFERRED EMBODIMENTS

Figure 1:
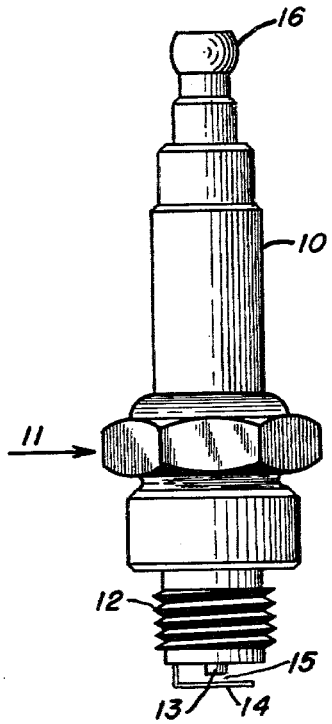
FIG. 1 is a side elevational view of a spark plug made in accordance with one embodiment of this invention.
Figure 3:
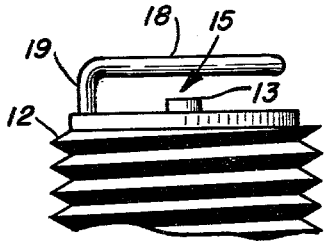
FIG. 3 is a cross-sectional view taken along the line 3—3 of FIG. 2.
Figure 4:
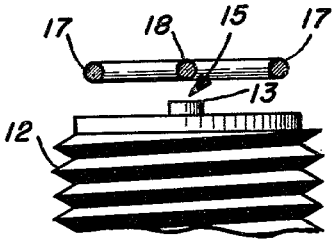
FIG. 4 is a cross-sectional view taken along the line 4—4 of FIG. 2.
Figure 5:
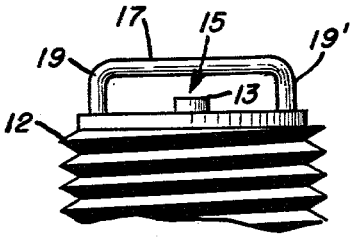
FIG. 5 is a cross-sectional view similar to FIG. 4 and showing a modified ground electrode secured to the spark plug shell at two points.
Figure 2:
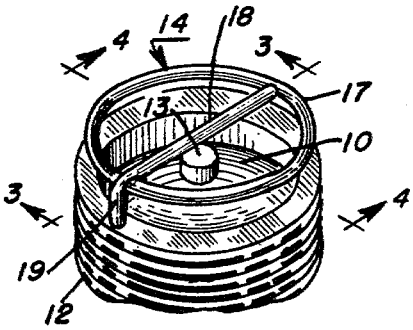
FIG. 2 is a fragmentary isometric view of the lower end portion of the spark plug and drawn to an enlarged scale.

Reference now is made to FIG. 1 wherein there is shown a spark plug comprising a ceramic core 10 carried by a metal shell 11 having an externally threaded portion 12. The lower end of the center, or main, electrode 13 is spaced from a ground electrode 14 to form a spark gap 15 and the upper end of the main electrode is secured to a metal terminal 16 for connection of the spark plug to the ignition system of an internal combustion engine. In accordance with one embodiment of this invention and as shown in FIGS. 2–4, the ground electrode comprises a ring member 17, a center bar 18 and a stem 19 which is welded or otherwise secured to the shell 12. Alternatively the ground electrode may include two stems secured to the shell as shown in FIG. 5 and identified by the reference numerals 19, 19'. However, the single stem arrangement permits adjustment of the length of the spark gap by the user.

Figure 6:
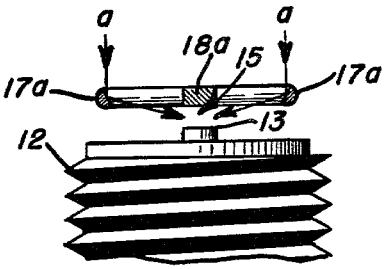
FIGS. 6–8 are cross-sectional views similar to FIG. 4 and showing ground electrodes having various cross-sectional configurations.
Figure 7:
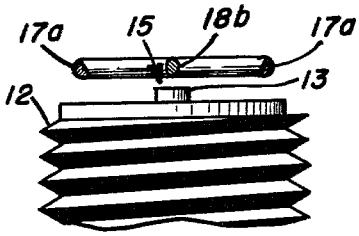
Figure 8:
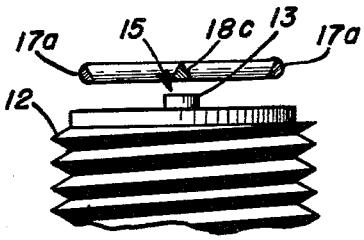

The members forming the ground electrode may have various cross-sectional shapes. For example, the center bar **18*a* shown in FIG. 6 has a rectangular cross-section, the center bar 18*b* in FIG. 7 has an oval corss-section, and the center bar 18*c*** in FIG. 8 has a triangular cross-section. The ring member of the ground electrode may have similar cross-sectional shapes.

When the spark plug is connected to an internal combustion engine the described ring member of the ground electrode functions to concentrate the fuel mixture in the spark gap during the compression cycle of the engine. This effect is enhanced when the ring member has a generally conical inner surface, such as the ring member **17*a* shown in FIGS. 6–8. More specifically, the ring member has a semi-circular cross-sectional configuration with a flat inner surface lying on a surface generated by a cone having an apex directed toward the main electrode. During the compression stroke of the engine cylinder, a portion of the fuel mixture is directed toward the spark gap 15**, as generally indicated by the arrows a. The momentary increase in the concentration of the fuel mixture in the spark gap, as compared to other regions of the engine cylinder, results in a positive ignition of the fuel mixure which can be much leaner than mixtures require for use with spark plugs of conventional construction. In an engine provided with conventional spark plugs, the air to gasoline ratio of the fuel mixture generally is 13.8/1. On the other hand, tests have shown that an engine provided with the described spark plugs operated smoothly and positively with a fuel mixture having an air to gasoline ration of at least 20/1. This not only results in fuel economy but also reduces the amount of pollutants discharged into the atmosphere.

Even though an engine provided with spark plugs as herein described operates with a lean fuel mixture, the engine horsepower is not decreased as would be expected. Although the exact theory of operation is not understood, it appears that the center bar of the ground electrode increases the speed of the flamefront, whereby the burn rate of the fuel is speeded up. This results in increased horsepower output and, also, a decrease in pollutants discharged into the atmosphere.

Having now described the invention what I desire to protect by letters patent is set forth in the following claims.

I claim:

1. A spark plug comprising, a - a core of insulating material carried by a metal shell, b - a main electrode carried by the core and having an end defining one end of the spark gap, c - a ground electrode comprising a ring member secured to the said shell and a cross bar extending over and spaced from the said end of the main electrode and defining the other end of the spark gap, said ring member having an inside diameter greater than the diameter of the said one end of the main electrode and lying in a plane which is spaced from the said one end of the main electrode and substantially normal to the axis of the spark plug, the said ring member having a semi-circular cross-sectional configuration with an inner surface lying on the surface generated by a cone having an apex directed toward the said main electrode, and said cross bar lying substantially in the plane containing the ring member.

2. A spark plug as recited in claim 1, wherein said cross bar has a rectangular cross-sectional congigura-tion.

3. A spark plug as recited in claim 1, wherein the said cross bar has an elliptical cross-sectional configuration.

4. A spark plug as recited in claim 1, wherein the said cross bar has a circular cross-sectional configuration.

5. A spark plug as recited in claim 1, wherein the said cross bar has a triangular configuration.

* * * * *